US007594720B2

(12) United States Patent
Kawakami et al.

(10) Patent No.: US 7,594,720 B2
(45) Date of Patent: Sep. 29, 2009

(54) RECORDING APPARATUS

(75) Inventors: Kazuhisa Kawakami, Yokohama (JP); Shinya Sonoda, Yokohama (JP); Tetsuhiro Nitta, Yokohama (JP); Toshihide Wada, Yokohama (JP); Hiroyuki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 11/145,981

(22) Filed: Jun. 7, 2005

(65) Prior Publication Data

US 2005/0280684 A1 Dec. 22, 2005

(30) Foreign Application Priority Data

Jun. 14, 2004 (JP) ..... 2004-175115

(51) Int. Cl.
*G03G 15/20* (2006.01)
*B41J 2/01* (2006.01)

(52) U.S. Cl. ..... 347/104; 347/42; 358/1.15; 358/296; 399/107; 399/110; 399/119; 399/306; 399/385; 399/91; 399/400; 399/401; 400/624

(58) Field of Classification Search ..... 347/30, 347/101, 104, 108
See application file for complete search history.

(56) References Cited

U.S. PATENT DOCUMENTS 6,220,692 B1 * 4/2001 Iwaya et al. ..... 347/33
6,685,294 B2 2/2004 Gaasch et al.
6,830,401 B1 * 12/2004 Hwang et al. ..... 400/693
6,890,071 B2 * 5/2005 Khormaei et al. ..... 347/104
2002/0060712 A1 * 5/2002 Sugimoto et al. ..... 347/30
2002/0158929 A1 * 10/2002 Gaasch et al. ..... 347/14
2003/0035039 A1 * 2/2003 Kanome et al. ..... 347/104
2003/0052956 A1 * 3/2003 Katsuyama ..... 347/108
2004/0017460 A1 * 1/2004 Kagami et al. ..... 347/104
2005/0052518 A1 * 3/2005 Kagami ..... 347/104
2005/0140081 A1 * 6/2005 Sugimura et al. ..... 271/118

FOREIGN PATENT DOCUMENTS

CN 1241490 1/2000
JP 2003-40505 2/2003

* cited by examiner

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A recording apparatus, in which a recording medium is fed from one side of the recording apparatus, and the recording medium that has been recorded is ejected from the one side of the recording apparatus, is capable of making its size when not in use smaller than the size when in use and also achieving a reduction in the depth dimension of the recording apparatus as compared with the case where a feed tray and a discharge tray are rotary storage trays. The recording apparatus includes a feed tray on which a recording medium is stacked and which is rotated to move between an in-use position and a stowed position, and an eject tray on which the recording medium that has been recorded is stacked and which moves between an in-use position and a stowed position in a discharge direction of the recording medium.

5 Claims, 9 Drawing Sheets

RECORDING APPARATUS

BACKGROUND OF THE INVENTION

Field of the Invention

The present invention relates to a recording apparatus in which a recording medium is fed from one side of the recording apparatus and the recording medium that has been recorded is discharged from the one side of the recording apparatus.

Ink jet recording apparatuses with which recording is performed by discharging ink from a recording means (recording head), are used for many recording applications including color recording, because the noise during the recording operation is relatively low and moreover fine dots can be formed at high densities. In particular, in order to achieve a further improvement in recording density or to enable finer color recording, those having a black ink recording means and a color ink recording means that are detachably mounted to a carriage, or those mounted with a detachable recording means integrating a black ink recording means and a color ink recording means together, have been put into practical use. As one type of such a recording apparatus, there is one including a U-turn transport path whereby a recording medium is fed from the front side of the recording apparatus, reversed at the back side of the recording apparatus, and then discharged again to the front side of the recording apparatus. In contrast, there is one including a so-called J transport path whereby a recording medium is fed from the top back side of the recording apparatus and the recording medium that has been recorded is transported to the front side of the recording apparatus for discharge.

Of those two kinds of transport paths, the recording apparatus having the U-turn transport path is advantageous in that the space required of the recording apparatus during the recording operation is relatively small, as compared with the case of the recording apparatus having the J transport path. On the other hand, as compared with the recording apparatus having the U-turn transport path, the recording apparatus having the J transport path involves relatively little deformation of the recording medium being transported even in the case of a thick recording medium, for example, which advantageously makes it possible to realize high-quality recording with respect to various recording mediums used. Meanwhile, as the recording apparatus having the U-turn transport path, there is one having a construction in which a feed tray, on which the recording medium is stacked and held, is stationary, and a discharge tray, on which the recording medium that has been recorded at a recording portion is stacked and held, is stationary or used as the upper cover of the feed tray, too. Further, there is one whose feed tray and discharge tray are both rotary trays.

However, the construction with the stationary feed tray is disadvantageous in that the same space as that required during use of the recording apparatus is required even when the recording apparatus is not in use. In this regard, in the case of the recording apparatus whose feed tray and discharge tray are both rotary trays, the space required by the recording apparatus when not in use can be made smaller than that required by the recording apparatus when in use; however, a space is required for the rotation and storage of the two trays, leading to an increase in the depth dimension of the recording apparatus itself.

The present invention can provide a recording apparatus whose size when not in use can be made smaller than its size when in use and which can be reduced in depth dimension as compared with the case where a feed tray and a discharge tray are both rotary storage trays.

The present invention can also provide a recording apparatus in which a recording medium is fed from one side of the recording apparatus and the recording medium that has been recorded is discharged from the one side of the recording apparatus, the recording apparatus including: a feed tray on which the recording medium is stacked and which is rotated to move between an in-use position and a stowed position; and an eject tray on which the recording medium that has been recorded is stacked and which moves between an in-use position and a stowed position in a discharge direction of the recording medium.

DESCRIPTION OF THE PREFERRED EMBODIMENTS

Figure 1:
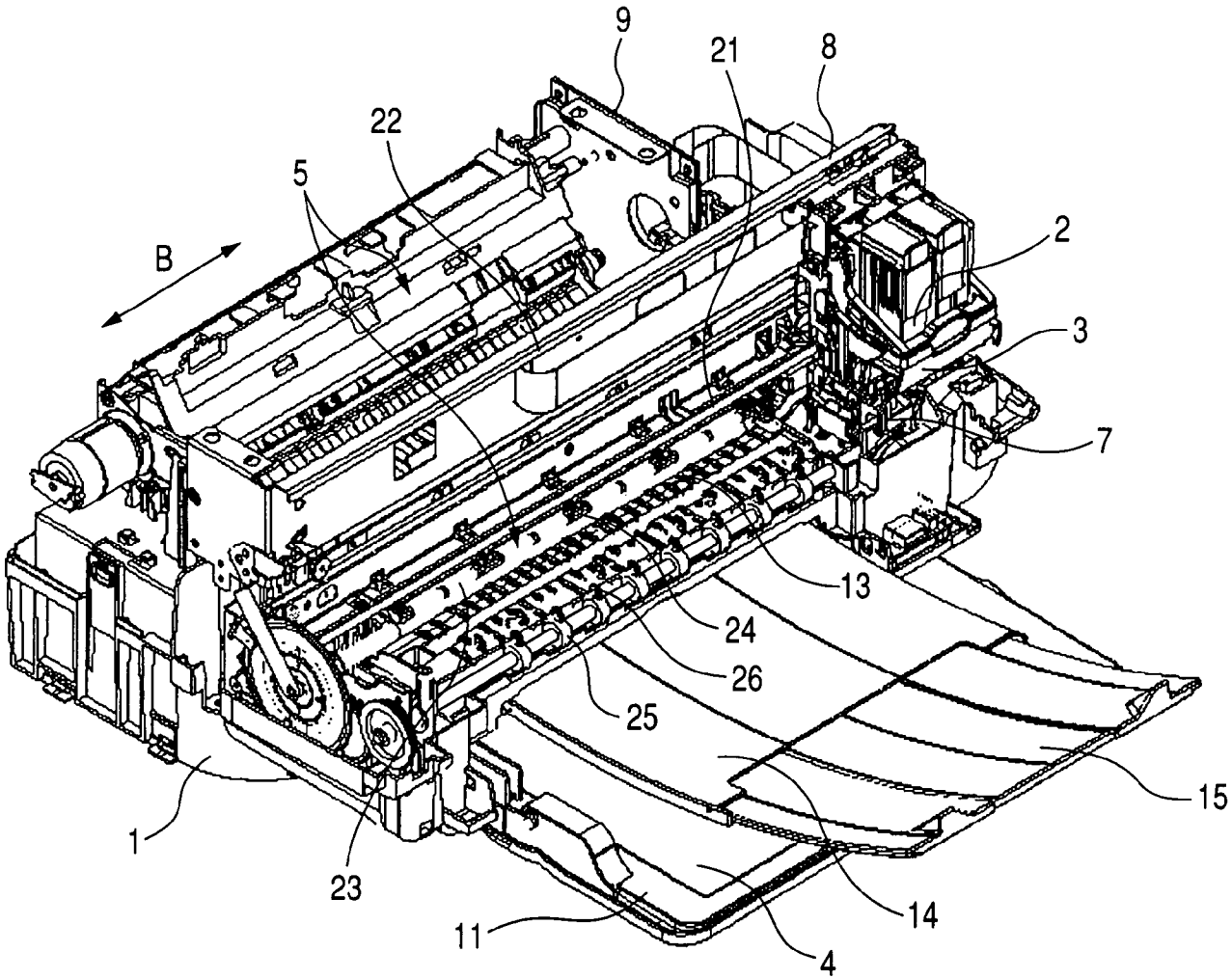
FIG. 1 is a perspective view showing a recording apparatus according to an embodiment of the present invention when in use.
Figure 2:
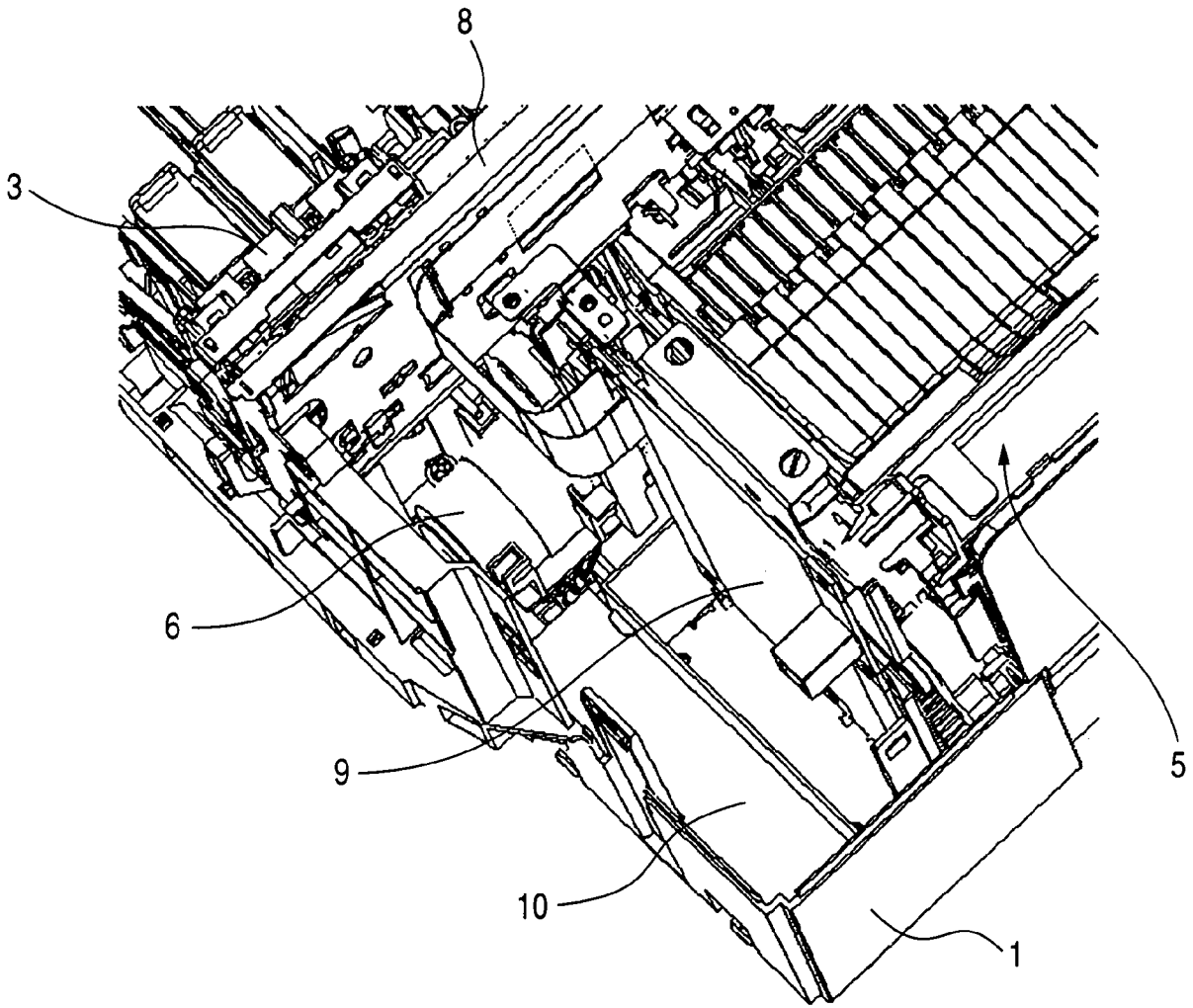
FIG. 2 is a perspective view showing a suction means and an ink absorbing member arranged at the right rear of the recording apparatus of FIG. 1.
Figure 3:
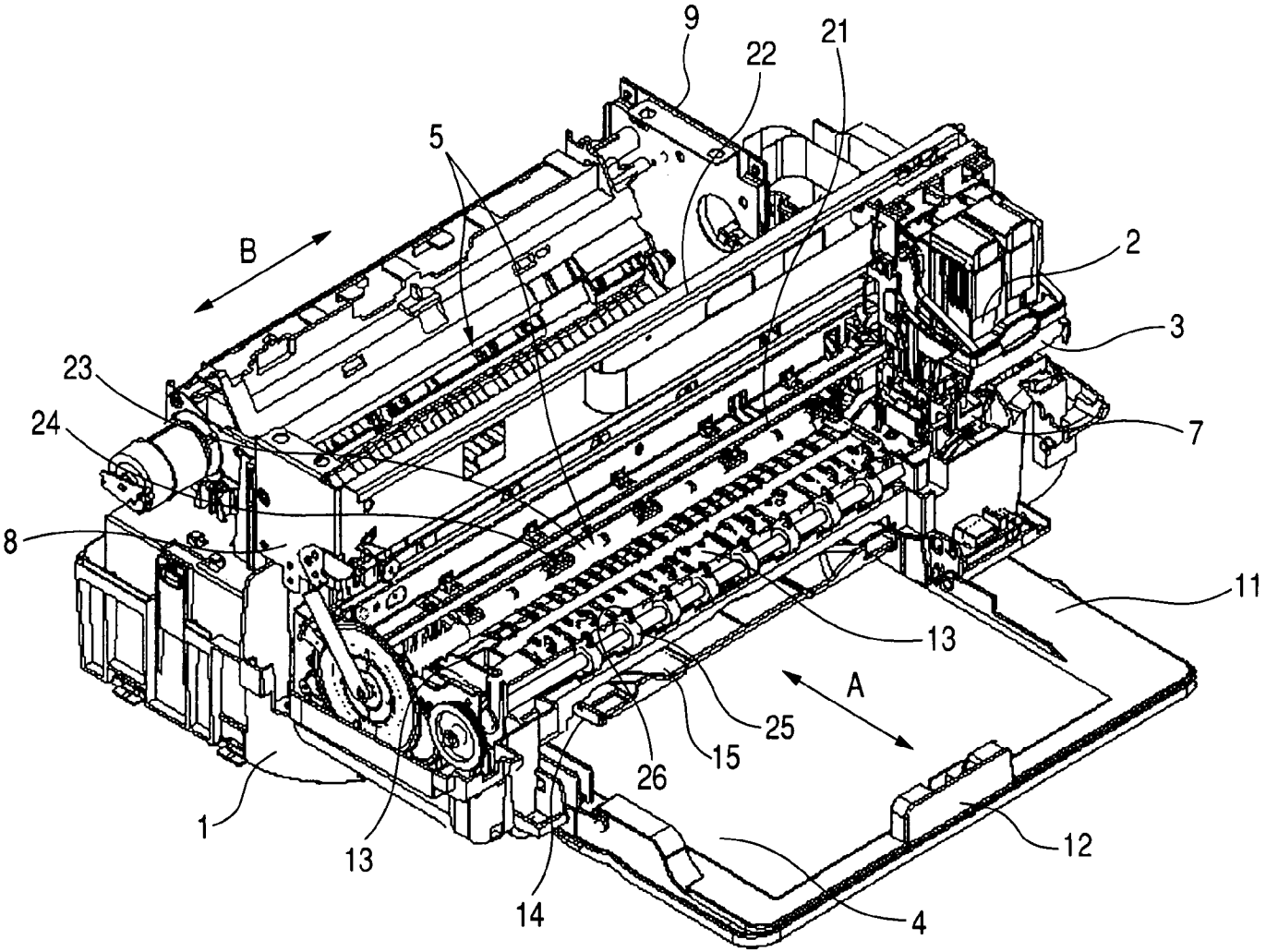
FIG. 3 is a perspective view showing the recording apparatus of FIG. 1 with a discharge tray being stored under a recording region.

Hereinbelow, embodiments of the present invention are specifically described with reference to the drawings. It is to be noted that throughout the figures, the same reference numerals denote the same or corresponding parts. FIG. 1 is a perspective view showing a recording apparatus according to an embodiment of the present invention when in use, FIG. 2 is a perspective view showing a suction pump and an ink absorbing member arranged at the right rear of the recording apparatus shown in FIG. 1, and FIG. 3 is a perspective view of the recording apparatus shown in FIG. 1 with a discharge tray being stored under a recording portion. The recording apparatus according to this embodiment has a structure in which a recording medium is fed from one side of the recording apparatus and the recording medium that has been recorded is discharged from the one side of the recording apparatus. Further, in this embodiment, the description is directed to a case where the recording apparatus is an ink jet recording apparatus using as the recording means an ink jet recording means for effecting recording by discharging ink to the recording medium.

The recording apparatus shown in the figures is equipped with a recording means (recording head) 2 for performing recording on a recording medium 4 such as a sheet or plastic thin plate, and a U-turn transport path for effecting return-transport of the recording medium so that feeding and discharge of the recording medium 4 are performed from the same side (the front side in the example shown in the figures) of the recording apparatus. Further, this embodiment exemplifies the case of a serial scan type recording apparatus that performs recording by means of the recording head 2 mounted in a carriage 3 capable of reciprocating in the right-to-left (hereinafter referred to as "lateral") direction (main scanning direction) with respect to a recording apparatus main body. Referring to FIG. 1, a chassis 8 is retained on a base portion 1 of the recording apparatus main body. Installed onto the chassis 8 is a laterally placed guide shaft 21, with a guide rail 22 in parallel to the guide shaft 21 being formed integrally with the chassis 8. The carriage 3 having the recording head 2 mounted therein is guided and supported by the guide shaft 21 and the guide rail 22 so as to be capable of reciprocating movement.

Retained on the base portion 1 is a transport portion 5 having a U-turn transport path for feeding and transporting the recording medium sheet by sheet from one side of the recording apparatus and further transporting the recording medium that has been recorded for discharge from the same side of the recording apparatus. Also retained on the base portion 1 is a recovery mechanism portion (maintenance portion) 7 for recovering and maintaining the normal ink discharge performance of the recording head 2. The recovery mechanism portion 7 is equipped with a suction pump 6 for sucking ink from the discharge port of the recording head 2 by capping the discharge port and thus generating a negative pressure within the cap.

Further, arranged in a portion at the right rear of the recording apparatus is a control board 9 for controlling the recording operation of the recording apparatus. The control board 9 is fixed to the right-hand side surface of the transport portion 5. Further, a feed tray 11, on which the recording medium 4 is stacked and held, is provided to the base portion 1 at a lower front position of the recording apparatus. The feed tray 11 is rotatably supported with respect to the base portion 1. Referring to FIG. 2, the suction pump 6 is arranged on the recording apparatus back surface side of the chassis 8 and on the right side (the left side in FIG. 2) of the transport portion 5. The suction pump 6 is arranged such that it does not affect the height of the carriage 3, realizing a construction that positively contributes to reducing the height of the recording apparatus main body. Further, arranged on the right side (the left side in FIG. 2) of the control board 9 is an ink absorbing member 10 for collecting and retaining ink sucked in from the recording head 2 by the suction pump 6. The arrangement of the ink absorbing member 10 at this position enables a reduction in the height of the recording apparatus main body.

Referring to FIG. 3, a trailing edge regulating portion 12 for regulating the trailing edge of the recording medium 4 is fitted on the feed tray 11 so as to be movable in the recording medium transporting direction (the arrow A direction). The trailing edge regulating portion 12 serves to hold the recording medium 4 at a fixed position, whereby only the uppermost sheet of the recording medium 4 stacked and held on the feed tray 11 can be fed onto a platen 13. Based on a recording command signal sent from the control board 9, the uppermost sheet of the recording medium 4 stacked and held on the feed tray 11 is fed to a recording portion on the platen 13 by a sheet feeding portion 20 (a sheet feed roller thereof) and the transport portion 5 (a transport roller 23 and a pinch roller 24 thereof). Once the recording medium 4 has been transported to the platen 13, the carriage 3 makes reciprocating movement in the direction (the arrow B direction) crossing the recording medium transporting direction and, at the same time, ink is discharged from the recording head 2 mounted in the carriage 3 according to recording information, whereby an image is recorded on the surface of the recording medium 4.

The recording medium 4 that has thus underdone recording is discharged by a discharge roller 25 and a spur 26, which are driven in synchronism with the discharge roller 23, onto discharge trays 14 and 15 shown in FIG. 1 to be held thereon. The discharge tray according to this embodiment is of an extendable structure composed of a proximal discharge tray 14 mounted to the recording apparatus, and an extension discharge tray 15 that can be drawn out and stored with respect to the proximal discharge tray 14. Multiple sheets of the recording medium 4 which have been recorded can be stacked and held on the discharge trays 14 and 15 that have been drawn out and extended.

Figure 4:
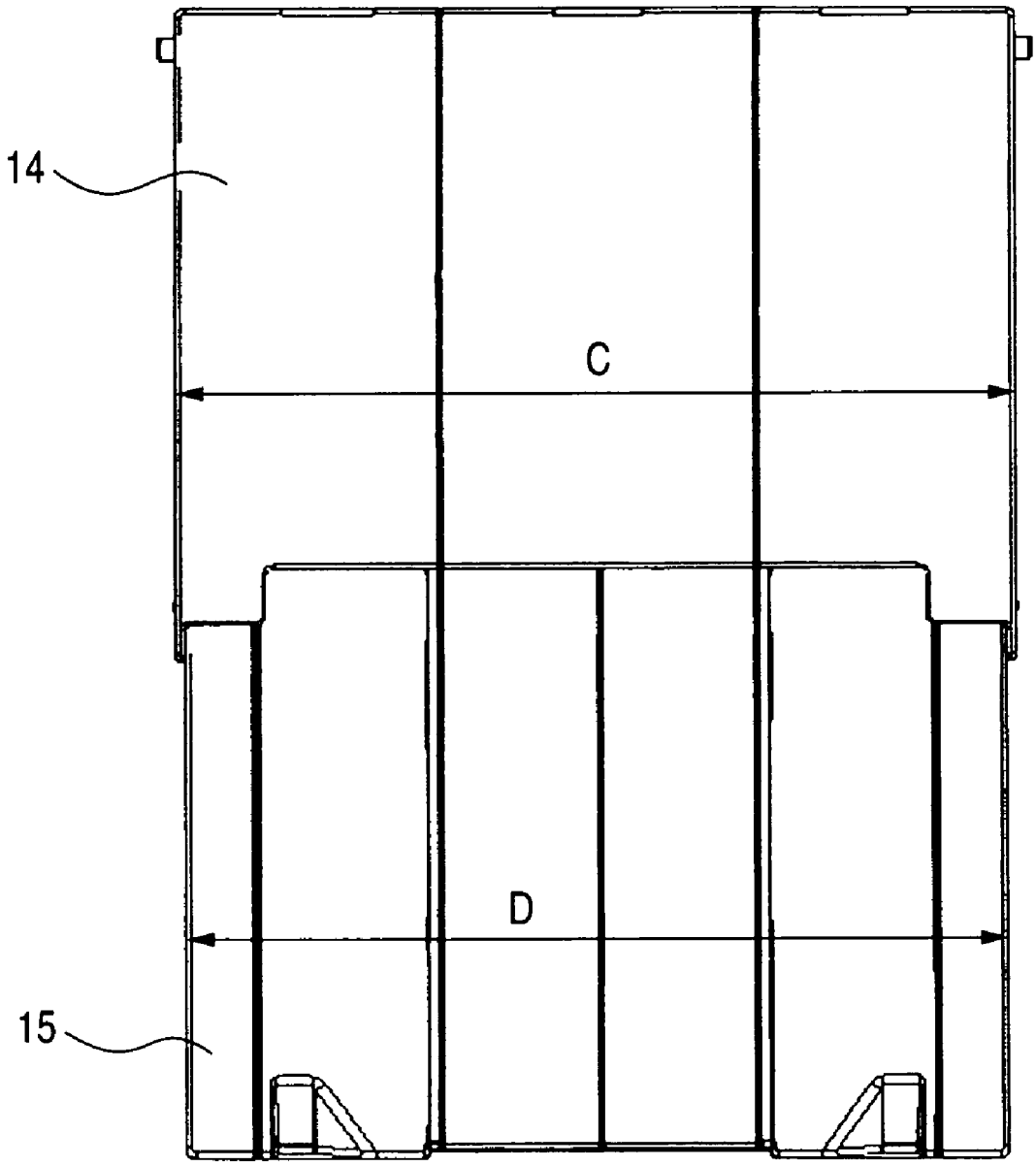
FIG. 4 is a plan view showing the discharge tray shown in FIG. 1 when in use.
Figure 5:
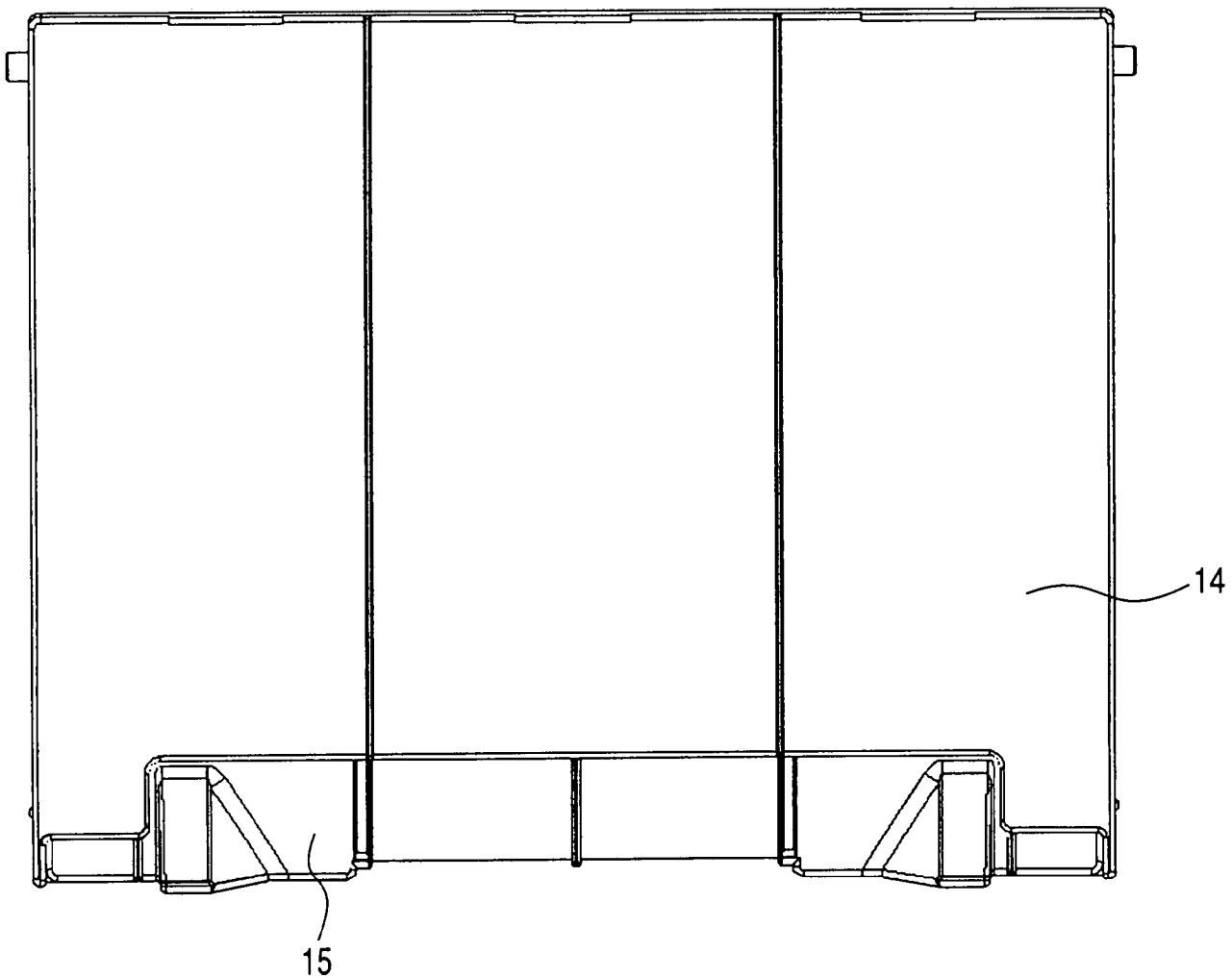
FIG. 5 is a plan view showing the discharge tray shown in FIG. 1 when stored.

FIG. 4 is a plan view showing the discharge trays 14 and 15 when in use (when extended), and FIG. 5 is a plan view showing the discharge trays 14 and 15 when stored (when stowed or contracted). As shown in FIG. 4, a length D of the extension discharge tray 15 on the distal end side is slightly smaller than a length C of the proximal discharge tray 14 on the mounting side, whereby, as shown in FIG. 5, the extension discharge tray 15 can be stored into the interior of the proximal discharge tray 14. A part of the proximal discharge tray 14 is cut away in the width direction so that the extension discharge tray 15 thus stored can be drawn out from the proximal discharge tray 14.

As a result, when not in use, that is, when stored, the tray is reduced by approximately half in length as compared with that when in use, while securing the requisite tray length for stacking and holding of the recording medium 4 that has been recorded when in use. Accordingly, the space necessary for storage of the discharge trays 14 and 15 in the recording apparatus main body can be reduced in length, thereby achieving a corresponding reduction in the depth dimension of the recording apparatus main body. Further, the height and width of the discharge trays 14 and 15 are set to the minimum possible dimensions while securing the requisite rigidity, which contributes to reduced height of the recording apparatus main body and also reduced width of the recording apparatus main body.

Figure 6:
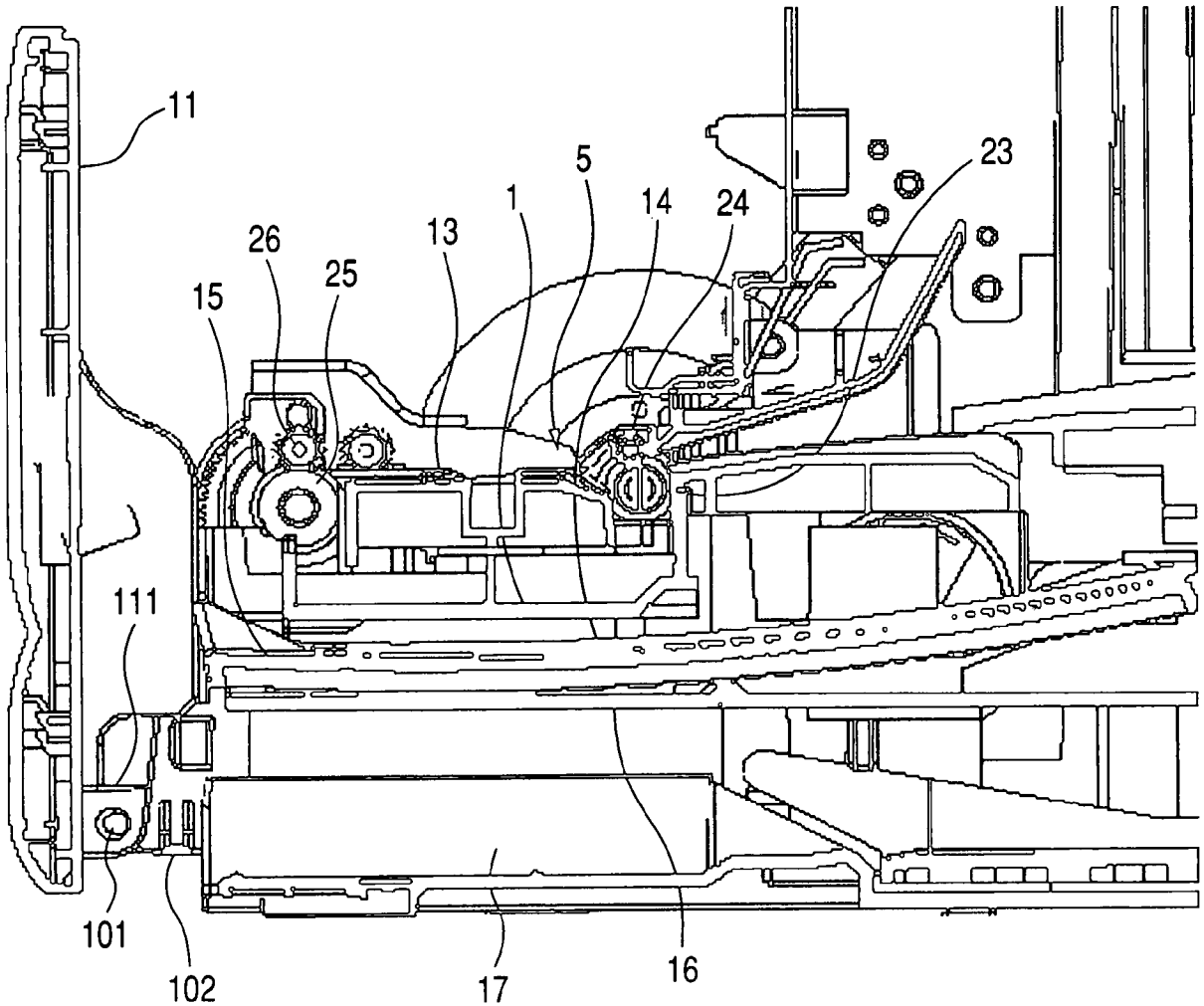
FIG. 6 is a partial longitudinal sectional view of the recording apparatus, with a feed tray and the discharge tray both being stored and not in use.
Figure 7:
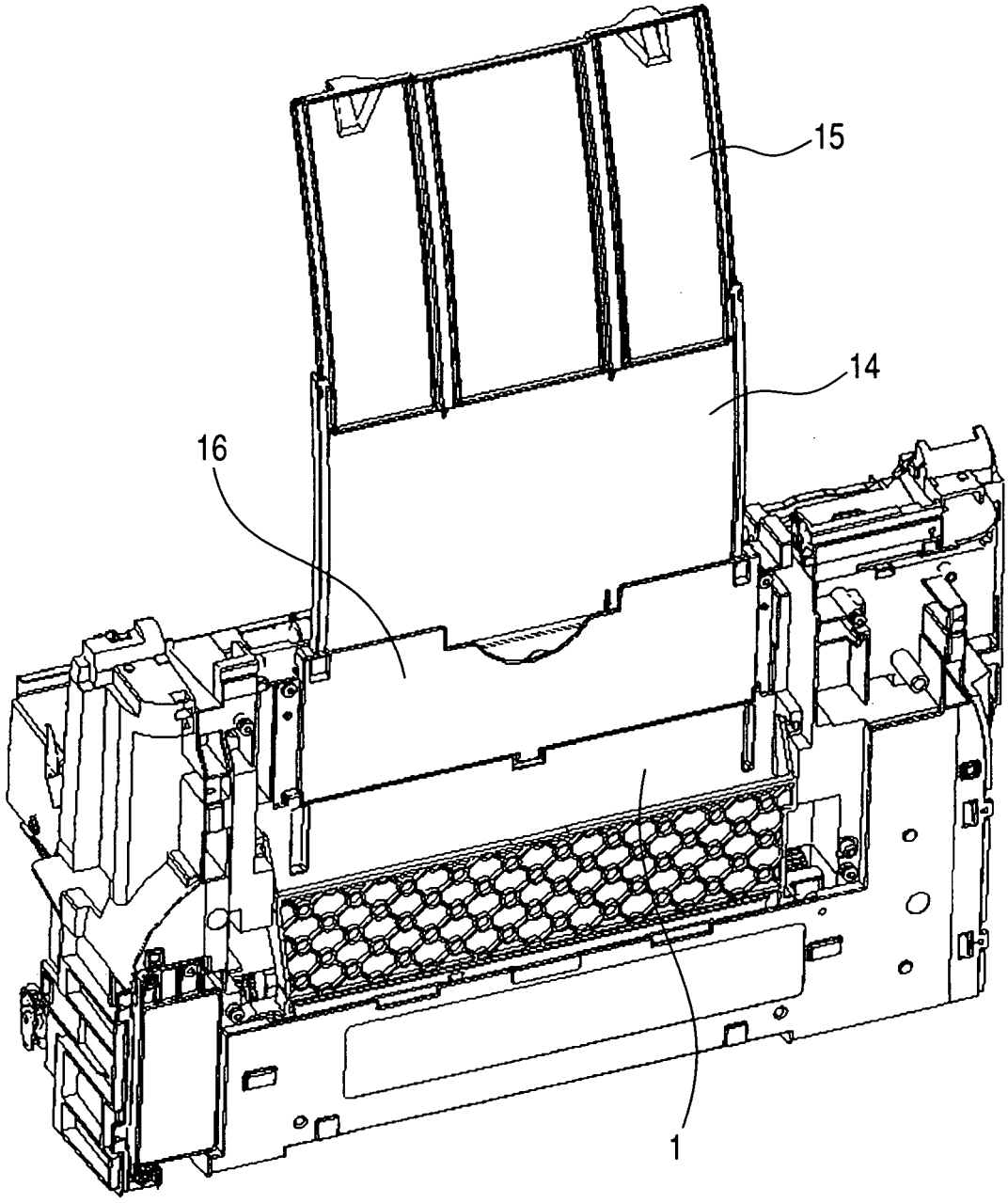
FIG. 7 is a perspective view of the recording apparatus as seen from below, with the discharge tray being in use and a part of components being removed.

FIG. 6 is a partial longitudinal sectional view showing a recording apparatus according to an embodiment of the present invention, with the feed tray 11 and the discharge trays 14 and 15 being both stored and not in use. FIG. 7 is a perspective view of the recording apparatus of FIG. 6 as seen from below, with the discharge trays 14 and 15 being in use and a part of components being removed. Referring to FIG. 6, the feed tray 11 is held by a bearing portion 111 so as to be rotatable about a shaft 101 provided to the base portion 1 of the recording apparatus. When in use, the feed tray 11 is positioned and held in a substantially horizontal attitude (opened attitude) allowing stacking of the recording medium. The base portion 1 is provided with a stopper portion 102 for retaining the opened attitude of the feed tray 11. As shown in FIG. 6, when not in use, the feed tray 11 is rotated into a substantially vertical attitude (folded attitude) to be positioned and held at that position by means of a holding mechanism. The shaft 101 and the stopper portion 102 are each provided at two locations in the recording apparatus width direction.

A discharge tray holding portion 16 is provided in the front inner portion of the recording apparatus, which in this embodiment is a portion below the platen 13, the transport roller 23 or the discharge roller 25. The discharge tray holding portion 16 holds the discharge trays 14 and 15 and also serves as a guide when loading the recording medium 4 in the feed tray 11. As shown in FIG. 6, when not in use, the discharge trays 14 and 15 are moved substantially horizontally on the discharge tray holding portion 16 in an overlapping manner for insertion and stored into the recording apparatus.

Further, provided below the discharge tray holding portion 16 is a feed guide 17 allowing stacking and holding of the recording medium 4 that has not been recorded, together with the feed tray 11. That is, the recording medium 4 in the stacked state prior to recording has its forward portion held by the feed guide 17 and has its rear portion held by the feed tray 11.

As shown in FIG. 6, when the feed tray 11 is rotated and folded for storage, and the discharge trays 14 and 15 are moved for storage into the interior of the recording apparatus, the size of the recording apparatus when not in use is made smaller than that when in use.

Further, the feed tray 11, the platen 13, and the discharge tray holding portion 16 are all mounted to the base portion 1.

As shown in FIG. 7, the discharge tray holding portion 16 has a width larger than those of the discharge trays 14 and 15 and is screw-fixed onto the base portion 1 at two lateral positions. Accordingly, when loading the recording medium 4 in the feed tray 11, the discharge tray holding portion 16 can guide the recording medium 4 over substantially the entire width thereof, whereby folding of the leading edge of the recording medium or the like can be prevented even when the recording medium is rather carelessly loaded in the feed tray 11.

Figure 8:
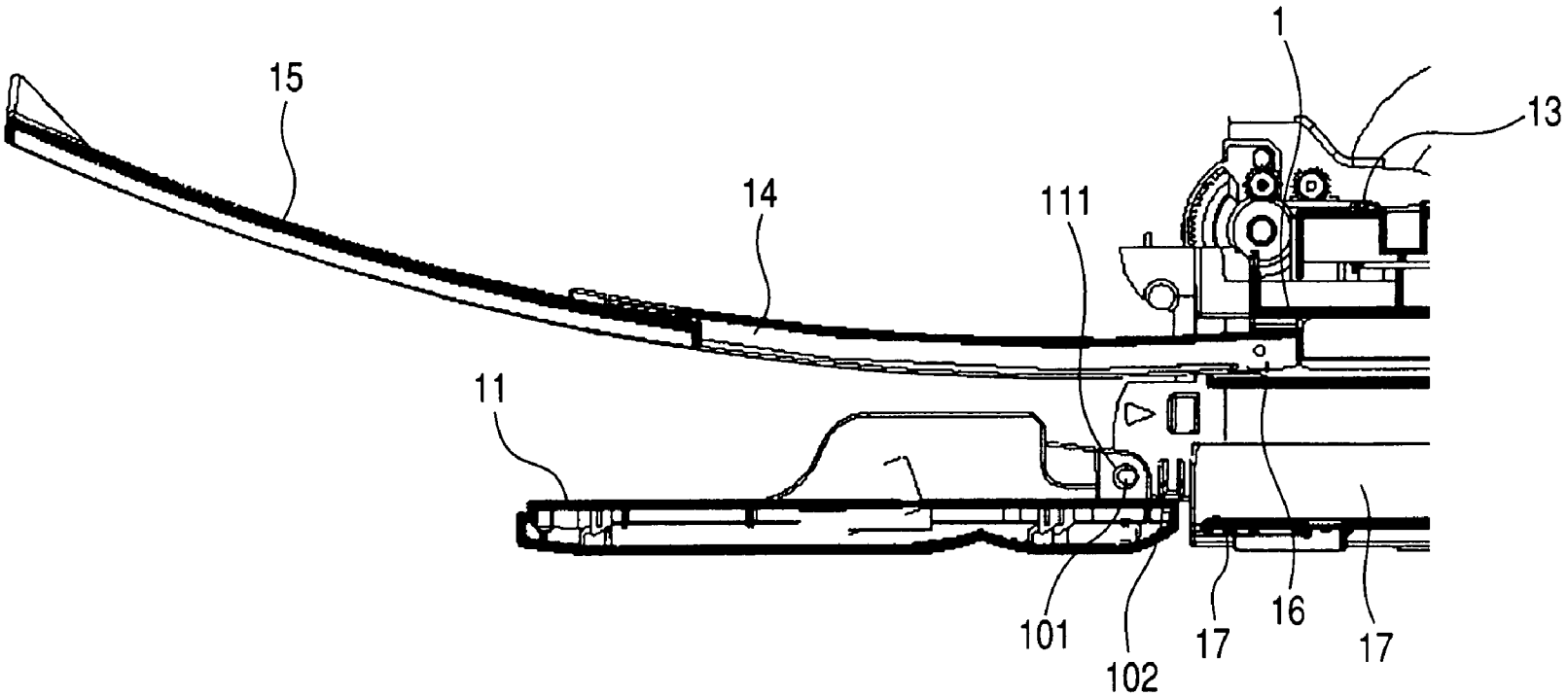
FIG. 8 is a partial longitudinal sectional view of the recording apparatus with the feed tray and the discharge tray being in use.

FIG. 8 is a partial longitudinal sectional view of the recording apparatus in the state when the feed tray and the discharge trays are in use. In this state, the discharge tray 14 on the proximal end side has its upper surface and lower surface held by a part of the base potion 1 and a part of the discharge tray holding portion 16, respectively, and retains that attitude by self weight. Further, the feed tray 11 retains its attitude by means of the stopper portion 102 of the base portion 1.

Figure 9:
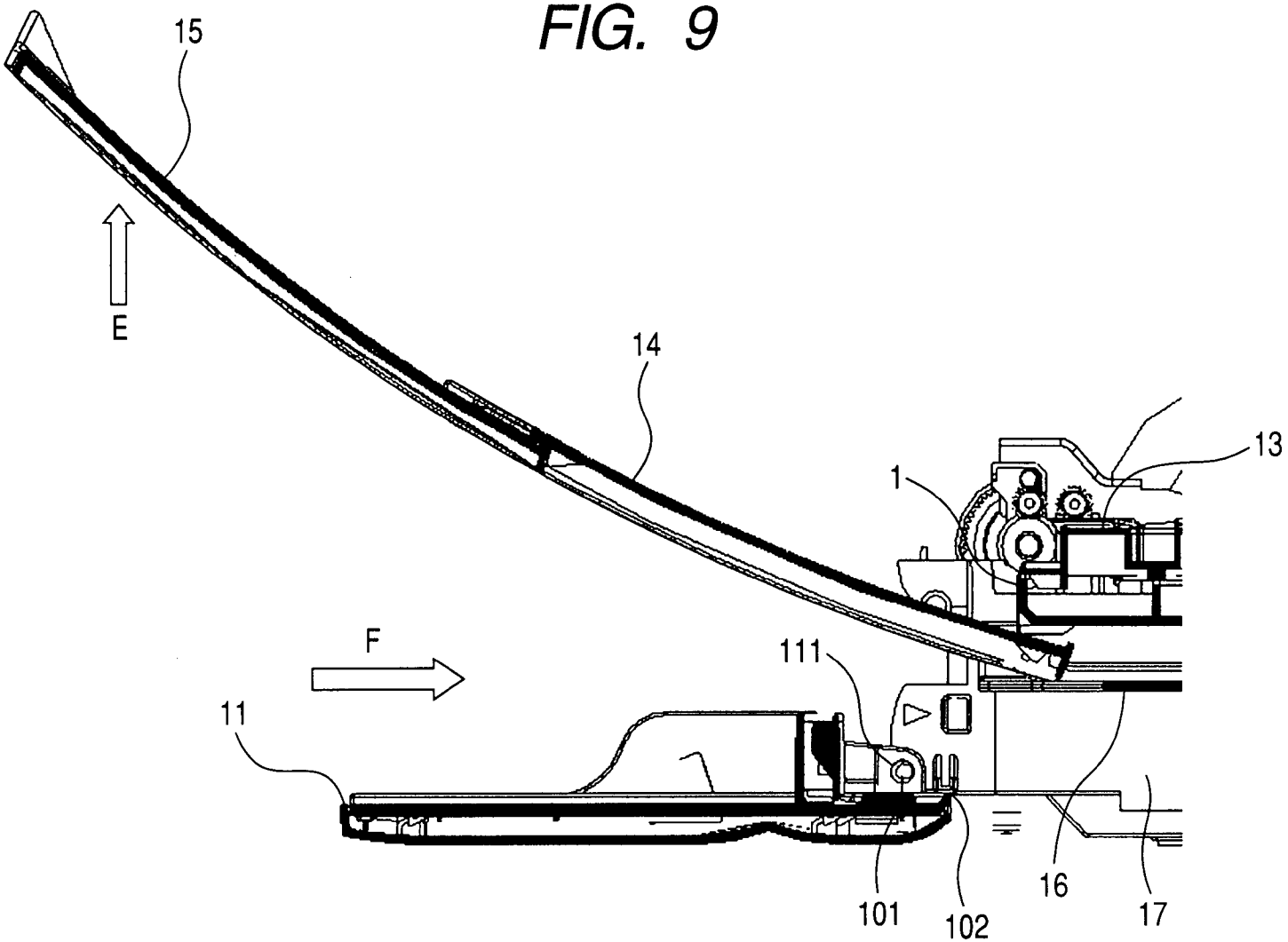
FIG. 9 is a partial longitudinal sectional view of the recording apparatus, with the feed tray and the discharge tray being in use and a recording medium being loaded onto the feed tray.

FIG. 9 is a partial longitudinal sectional view of the recording apparatus, with the feed tray and the discharge trays being in use and the recording medium being loaded onto the feed tray. As shown in FIG. 9, the space between the feed tray 11 and the discharge trays 14 and 15 can be enlarged by moving the discharge tray 15 on the distal end side in the arrow E direction against its self weight, thereby facilitating loading of the recording medium 4 in the arrow F direction.

The embodiment described in the foregoing is directed to the case of the recording apparatus with which the recording medium 4 is fed from one side of the recording apparatus and the recording medium that has been recorded is discharged from the one side of the recording apparatus. The characteristic feature of the recording apparatus resides in the provision of the feed tray 11 which can be rotated to move between the in-use state and the stored state and on which the recording medium is stacked, and the discharge trays 14 and 15 moving between the in-use state and the stored state in the discharge direction of the recording medium and on which the recording medium that has recorded is stacked. With this construction, the size of the recording apparatus when not in use can be made smaller than that of the recording apparatus when in use, and also the depth dimension of the recording apparatus can be reduced as compared with the case where the feed tray and the discharge trays are rotary storage trays.

Further, according to the above-described embodiment, the recording apparatus has: the discharge trays 14 and 15 on which the recording medium that has been recorded is stacked and held and which are held under the recording region, where recording is performed on the recording medium 4 by the recording means 2, such that the discharge trays 14 and 15 can be drawn out and stored by moving them in the longitudinal direction of the recording apparatus; the feed tray 11 on which a part of the recording medium 4 prior to recording is stacked and held and which is axially supported to the recording apparatus so as to be rotatable between the in-use position and the stored position; and the feed guide 17 which is situated under the discharge trays 14 and 15 that have been stored and on which a portion of the recording medium 4 prior to recording other than a portion of the recording medium stacked and held on the feed tray 11 is stacked and held. With this construction, a further reduction in the depth dimension of the recording apparatus can be achieved by moving the discharge trays 14 and 15 for storage under the recording region.

Further, by providing the discharge tray holding portion 16 which, with the discharge trays 14 and 15 being drawn out, holds the discharge trays 14 and 15 so as to allow their upward swinging movement, the space above the feed tray 11 can be enlarged through the upward swinging movement of the discharge trays 14 and 15 when loading the recording medium 4 prior to recording in the feed tray 11, thereby facilitating the loading of the recording medium 4. Further, the discharge tray holding portion 16 is provided over the entire width of the discharge trays 14 and 15, allowing the discharge tray holding portion 16 also to function as the upper guide when loading the recording medium 4 that has not been recorded, whereby such problems as the folding of the leading edge portion can be eliminated even when the recording medium is loaded rather carelessly.

Further, the shaft 101 and the bearing portion 111 that rotatably support the feed tray 11, and the mounting portion of the discharge tray holding portion 16, are provided in a common member (the base portion 1), whereby improved recording accuracy can be achieved by improving the accuracy with which the feed tray 11 and the discharge trays 14 and 15 are mounted. Further, the recording means 2 used is an ink jet recording means for performing recording through ink discharge. In this regard, an increase in the recording apparatus height can be easily suppressed by arranging the ink absorbing member 10, which serves to absorb and retain ink sucked in from the recording means, at a position other than the recording region and the recording medium transport portion 5. An increase in the recording apparatus height can also be easily suppressed by arranging the suction means 6, which serves to suck ink from the recording means 2, at a position other than the position under the movement range of the recording means.

Further, while in the above-described embodiment the description is directed to the case of a serial recording type recording apparatus that performs recording while relatively moving (main scanning) the recording means with respect to a recording sheet as a target recording medium, the present invention is similarly applicable to a line recording type recording apparatus that effects recording only through sub-scanning using a line type recording means of a length that covers the entirety or a part of the width of the target recording medium, and the same operational effects as described above can be achieved in this case as well. Further, the present invention is also applicable to a recording apparatus using one recording means, a color recording apparatus using a plurality of recording means for recording with inks of different colors, a gradation recording apparatus using a plurality of recording means for effecting recording in the same single color at different densities, or a recording apparatus combining those types of recording apparatuses, and the same operational effects as described above can be achieved in this case as well.

Further, in the case where the present invention is to be applied to an ink jet recording apparatus, the present invention is applicable to any types of arrangement and construction of the recording means and the ink tank, such as a construction using a replaceable ink cartridge integrating the recording means and the ink tank together, and a construction in which the recording means and the ink tank are formed separately, the connection between the two components being established by an ink supply tube or the like. The same operational effects as described above can be achieved in this case as well. Note that in the case where the present invention is to be applied to an ink jet recording apparatus, the present invention is also applicable to an ink jet recording apparatus that employs a recording means using an electromechanical transducer such as a piezoelectric element, for example. In this regard, the present invention proves particularly advantageous when applied to an ink jet recording apparatus that employs a recording means of a type which effects ink discharge by utilizing thermal energy.

According to the present invention, the size of the recording apparatus when not in use can be made smaller than that of the recording apparatus when in use, and also the depth dimension of the recording apparatus can be reduced as compared with the case where the feed tray and the discharge trays are rotary storage trays.

This application claims priority from Japanese Patent Application No. 2004-175115 filed on Jun. 14, 2004, which is hereby incorporated by reference herein.

What is claimed is:

1. A recording apparatus in which a recording medium is fed from one side of the recording apparatus, and the recording medium on which a recording head has recorded is ejected from the one side of the recording apparatus, the recording apparatus comprising:

a feed tray on which the recording medium is stacked and which is rotated to move between an in-use position and a stowed position;

an eject tray on which the recording medium on which the recording head has recorded is stacked, and which moves between an in-use position and a stowed position in a substantially horizontal direction, wherein said eject tray is arranged over said feed tray when said eject tray is in the in-use position; and an eject tray holding portion which guides a movement of said eject tray in a substantially horizontal direction, wherein when said eject tray is situated in the stowed position, said eject tray is not arranged over said feed tray, and said eject tray does not prevent the recording medium from being ejected.

2. A recording apparatus according to claim 1, wherein said eject tray holding portion is provided over an entire width of said eject tray.

3. A recording apparatus according to claim 1, further comprising a bearing portion for rotatably supporting said feed tray, wherein said bearing portion and a mounting portion of said eject tray holding portion are provided in a common member.

4. A recording apparatus according to claim 1, further comprising a recording head and an ink absorbing member for absorbing and retaining ink sucked in from said recording head, wherein said recording head is an ink jet recording head for performing recording through ink discharge, and said ink absorbing member is arranged at a position excluding a recording region and a recording medium transport portion.

5. A recording apparatus according to claim 1, further comprising a recording head and suction means for sucking ink from said recording head, wherein said recording head is an ink jet recording head for performing recording through ink discharge, and said suction means is arranged at a position excluding a portion below a movement range of said recording head.

* * * * *